US008914992B1

(12) United States Patent
Kaufman et al.

(10) Patent No.: US 8,914,992 B1
(45) Date of Patent: Dec. 23, 2014

(54) SHOE SOLE WITH DECORATIVE INSERT

(75) Inventors: Paul Kaufman, Santa Monica, CA (US); Steve Rosen, Diamond Bar, CA (US); Jack Silvera, Pacific Palisades, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 850 days.

(21) Appl. No.: 12/792,401

(22) Filed: Jun. 2, 2010

Related U.S. Application Data

(63) Continuation of application No. 11/745,412, filed on May 7, 2007, now Pat. No. 7,752,695.

(60) Provisional application No. 60/746,818, filed on May 9, 2006.

(51) Int. Cl.
*A43B 3/12* (2006.01)
*A43B 13/28* (2006.01)

(52) U.S. Cl.
USPC ..... 36/11.5; 36/24.5; 36/25 R

(58) Field of Classification Search
USPC ..... 36/11.5, 24.5, 25 R; 12/142 J
See application file for complete search history.

(56) References Cited

U.S. PATENT DOCUMENTS

| | | | | | |
|---|---|---|---|---|---|
| 2,212,613 | A | * | 8/1940 | Messina | 36/81 |
| 2,299,840 | A | * | 10/1942 | Merritt | 36/34 B |
| 2,352,098 | A | * | 6/1944 | Hess | 36/11.5 |
| 2,505,672 | A | * | 4/1950 | Hickey | 36/11.5 |
| 2,759,284 | A | * | 8/1956 | Santisi | 36/11.5 |
| 2,838,776 | A | * | 6/1958 | Tax | 12/142 N |
| 2,917,757 | A | * | 12/1959 | Scholl | 12/146 M |
| 3,673,714 | A | * | 7/1972 | Procopio | 36/81 |
| 3,965,516 | A | * | 6/1976 | Romero | 12/142 V |
| 4,073,024 | A | * | 2/1978 | Stix | 12/142 J |
| 4,265,032 | A | * | 5/1981 | Levine | 36/11.5 |
| 4,434,518 | A | * | 3/1984 | Watanabe | 12/142 RS |
| 4,694,831 | A | * | 9/1987 | Seltzer | 36/141 |
| 4,896,440 | A | * | 1/1990 | Salaverria | 36/11.5 |
| 5,901,394 | A | * | 5/1999 | Greenawalt | 12/142 N |
| 6,691,360 | B2 | * | 2/2004 | Mukherjee et al. | 12/142 C |
| 2003/0200675 | A1 | * | 10/2003 | Gross | 36/15 |

* cited by examiner

*Primary Examiner* — Ted Kavanaugh
(74) *Attorney, Agent, or Firm* — Joseph G. Swan, P.C.

(57) ABSTRACT

Provided are, among other things, systems, methods and techniques for manufacturing a shoe sole, in which a shoe sole is preliminarily assembled by bonding together a plurality of layers with a temporary insert disposed between two adjacent layers. Then, an outer edge of the shoe sole is ground and, following that, the temporary insert is removed and a permanent insert is bonded in place of the temporary insert, such that the permanent insert forms a portion of a side wall of the shoe sole.

19 Claims, 2 Drawing Sheets

SHOE SOLE WITH DECORATIVE INSERT

This application is a continuation of U.S. patent application Ser. No. 11/745,412, filed on May 7, 2007, now U.S. Pat. No. 7,752,695, which claimed the benefit of U.S. Provisional Patent Application Ser. No. 60/746,818, filed on May 9, 2006, and titled "Shoe and Shoe-Manufacturing Process Using Temporary Insert". Both such applications are incorporated by reference herein as though set forth herein in full.

FIELD OF THE INVENTION

The present invention pertains to footwear and techniques for making footwear, and is particularly applicable to an article of footwear having an insert bonded into its sole.

BACKGROUND

Certain shoes have a wedge or other type of insert in their heel portions. Often, a wedge insert is used to elevate the shoe's heel. Conventionally, such a shoe is constructed by cutting out different layers that ultimately will make up the shoe's sole (i.e., the portion of the shoe that is beneath the wearer's foot) and then bonding those layers together using an adhesive material. However, prior to bonding two of such adjacent layers together, a wedge of the desired shape is inserted at the back of the shoe between such two adjacent layers. Then, instead of bonding the upper and lower layers directly together along their entire surface areas, the upper layer is bonded to the top surface of the wedge and the lower layer is bonded to the bottom surface of the wedge. For the portion of the shoe that is forward of the wedge, the two adjacent layers generally are bonded directly to each other.

Once all of the foregoing steps have been completed, the sides of the shoe's sole are ground down, in order to smooth out any sections where the layers do not match precisely, to de-emphasize any seams between the layers (e.g., to provide the appearance of a single non-layered material), and to provide any desired shaping of the sole's side surfaces (e.g., to provide rounding, grooves or other three-dimensional patterns).

However, the present inventors have discovered that, when using the conventional production technique described above, because a significant portion of the insert's side walls also are exposed, the grinding of the layers comprising the shoe's sole almost necessarily results in grinding at least a portion of the inserted wedge. That is, even manual grinding usually cannot be limited strictly to the other layers of the shoe's sole; some of the grinding will overlap onto the sides of the insert. Any attempts to prevent such overlap generally would require extreme care that would substantially increase the cost of the finished product and, therefore, would be unfeasible for mass, medium-scale or large-scale production. The end result is that at least some portion of the inserted wedge (e.g., along its bottom and top edges) also will be ground down.

For some shoes, this result is acceptable or even desirable. The best example of such a case is where there is a desire for the shoe's heel to have a uniform appearance, i.e., so that there is no indication that the heel is in fact comprised of multiple layers and a separate wedge. Depending upon the type of grinding surface that is used, the side walls of the shoe's heel will appear to be uniformly smooth or textured.

However, the present inventors have discovered that such a manufacturing technique limits the types of wedges and other inserts that can be used within a shoe's sole, as well as the variety of shoe designs that can be made with an insert. For example, using such a conventional technique generally precludes one from inserting a decorative wedge, or at least one that has a fully decorated outer surface, because the subsequent grinding generally would obliterate such surface decorations. At the same time, simply omitting the grinding step generally would have the undesirable effect of leaving intact any production imperfections that exist after the individual layers have been bonded together.

SUMMARY OF THE INVENTION

Generally speaking, the present invention addresses this problem by providing a production technique in which a temporary insert is placed into the heel of a shoe (e.g., to provide the shoe with its desired final shape) during the grinding process. Then, upon completion of the grinding process, the temporary insert is removed and replaced with the desired permanent insert.

Thus, in one aspect, the invention is directed to systems, methods and techniques for making a shoe sole, in which a shoe sole is preliminarily assembled by bonding together a plurality of layers with a temporary insert disposed between two adjacent layers. Then, an outer edge of the shoe sole is ground and, following that, the temporary insert is removed and a permanent insert is bonded in place of the temporary insert, such that the permanent insert forms a portion of a side wall of the shoe sole.

By virtue of the foregoing arrangement, it is possible, e.g., to produce a wide variety of shoes with decorative inserts, which would not be possible, or at least would be significantly more difficult and expense to produce, using conventional techniques.

The foregoing summary is intended merely to provide a brief description of certain aspects of the invention. A more complete understanding of the invention can be obtained by referring to the claims and the following detailed description of the preferred embodiments in connection with the accompanying figures.

DESCRIPTION OF THE PREFERRED EMBODIMENT(S)

In the preferred embodiments of the invention, the initial steps in a process for making a shoe with an insert are very similar to the conventional process described above, with one significant exception. As in the conventional technique, in the present technique the layers are bonded together with an insert in between two adjacent layers. However, in the present invention, rather than using the same insert that is intended to be a permanent part of the shoe, a temporary insert is used during the grinding step.

Figure 1:
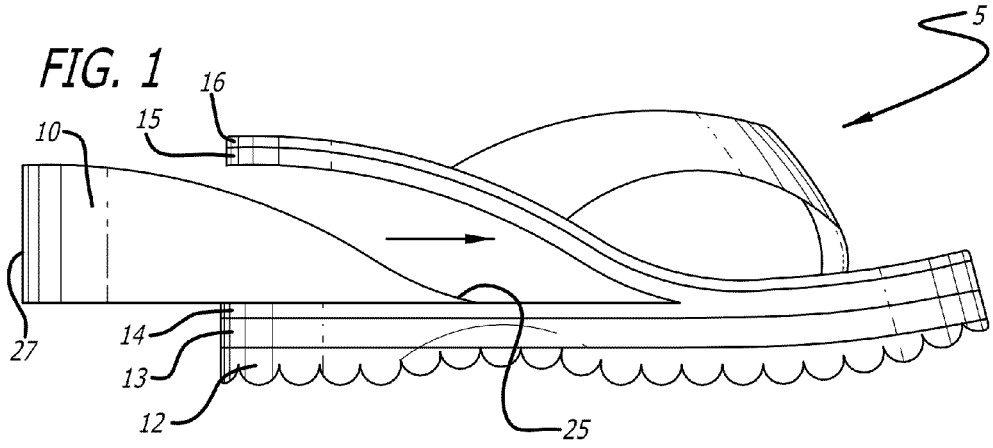
FIG. 1 is an exploded right side elevational view of a shoe according to a representative embodiment of the present invention.
Figure 2:
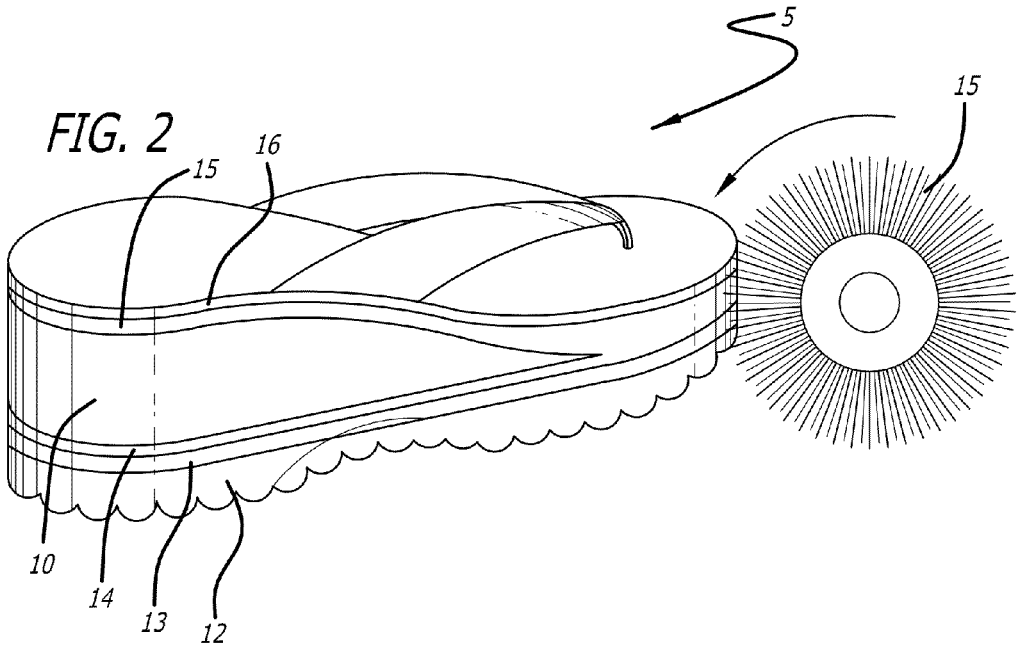
FIG. 2 is a perspective view of a shoe having a temporary insert installed, with its sole being ground, according to a representative embodiment of the present invention.

More specifically, in the production technique according to the present invention, a temporary insert (e.g., wedge 10 in FIGS. 1 and 2) is inserted into the heel of a shoe 5. In the preferred embodiments, the purpose of the temporary insert 10 is to provide the shoe 5 with its desired final shape (e.g., the shape that the shoe 5 will have when the permanent insert 30 is in place) during the grinding step (e.g., using grinder 15), without the necessity of using the insert 30 that will be permanently used in the shoe 5.

Figure 3:
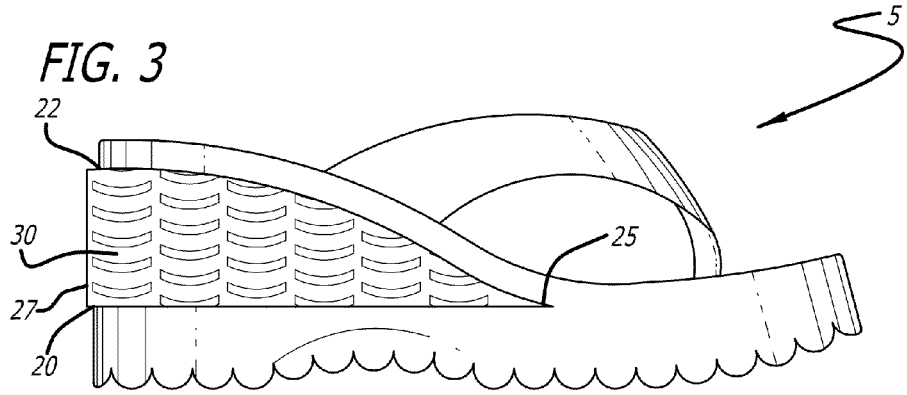
FIG. 3 is a right side elevational view of a completed shoe including a permanent insert according to a representative embodiment of the present invention.

As noted above, and as indicated in FIG. 3, in the present embodiment, the separate layers 12-16 are no longer easily distinguishable after such grinding has been performed. However, in alternate embodiments, where the various layers have different colors, the final appearance will be a single piece with different colored bands.

When the grinding step is completed, the temporary wedge 10 is removed and replaced with the desired insert (e.g., wedge 30 shown in FIG. 3), which is then permanently bonded into place. During the grinding process, the temporary wedge 10 may be held in place with a temporary adhesive, by clamping (e.g., using a C-clamp), by manually holding the temporary insert 10 in place, and/or by using any other temporary holding means. As in the conventional technique, the sides of the permanent insert 30 form a part of the sole's sidewall. However, because a temporary insert 10 is used during the grinding step, the grinding does not cause any damage to the permanent insert 30.

In the preferred embodiments, the temporary insert (e.g., wedge 10) has a shape that is identical or substantially similar to the shape of the desired final insert (e.g., wedge 30). More preferably, with respect to the portion of the wedge that is directly between the two adjacent layers 14 and 15 of the shoe's sole (i.e., within the "footprint" of the sole's other layers 12-16), the temporary wedge 10 has exactly the same (or substantially the same) shape as the desired final wedge 30, thereby providing the same (or substantially the same) shape to the shoe that the desired final wedge 30 would provide. However, the sidewalls of the temporary wedge 10 preferably are substantially smooth and vertical, or even somewhat concave, thereby facilitating the grinding step, even if the desired final wedge 30 will have textured and/or convex sidewalls (which otherwise would be likely to interfere with the grinding step).

By virtue of the foregoing technique, a variety of shoe designs are possible that could not be made in an easy or a cost-effective manner using conventional approaches. For example, as already noted above, the present technique provides for the possibility of using textured wedge inserts 30, even where the texturing covers the entire outer surface of the wedge 30 (or substantially all of such outer surface) and even where such texturing extends to the bottom edge 20 and/or top edge 22 of the wedge 30. Similarly, wedges 30 can be used that are pre-decorated, even where such decoration (e.g., with decals, surface paint or the like) covers the entire outer surface of the wedge 30 (or substantially all of such outer surface) and even where such decoration extends to the bottom edge 20 and/or top edge 22 of the wedge.

Figure 4:
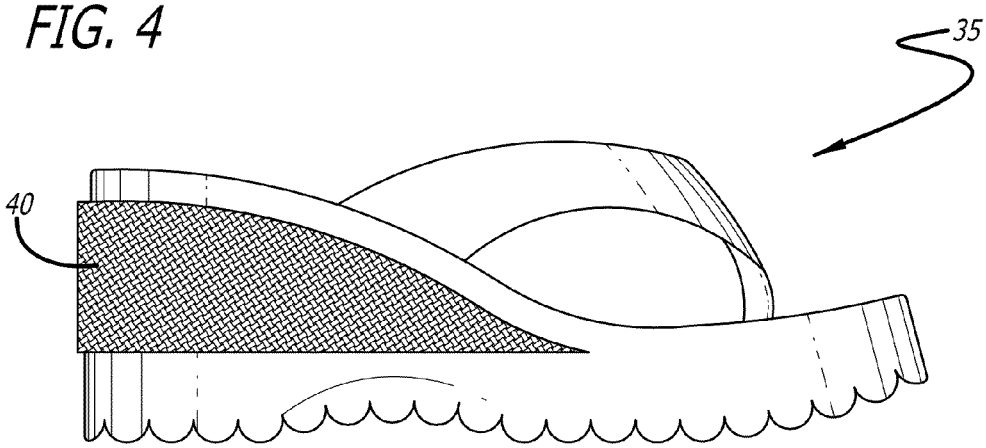
FIG. 4 is a right side elevational view of a completed shoe including a permanent insert having a woven outer surface according to a representative embodiment of the present invention.
Figure 5:
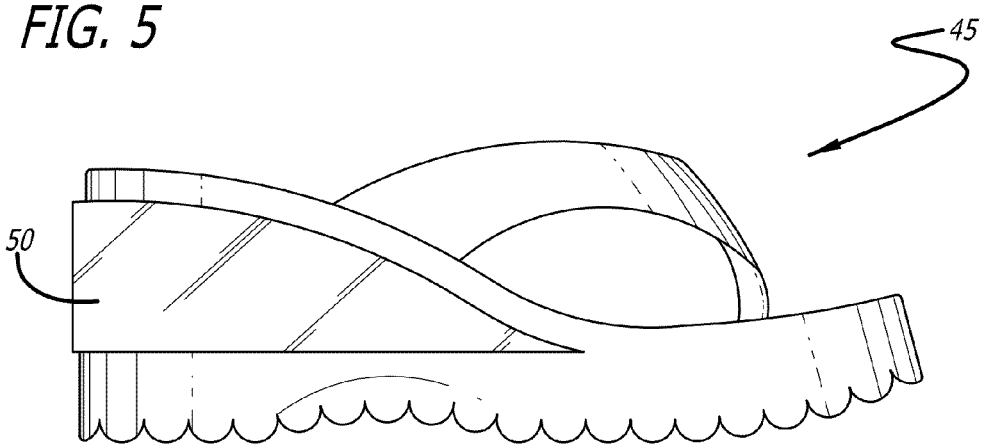
FIG. 5 is a right side elevational view of a completed shoe including a permanent insert having a high-gloss or clear plastic coating on its outer surface according to a representative embodiment of the present invention.

Moreover, such considerations apply whether such texturing and/or other decoration is separately fabricated or is an intrinsic part of the material that is used to form wedge 30. Thus, for example, a wedge 30 used in the technique of the present invention can have a woven outer surface, a rope-like outer surface, a decorative veneer outer surface, a high-gloss coating on its outer surface, a textile wrap, an outer decal, a clear plastic coating, or any other outer surface that otherwise would be damaged by the grinding process. It is noted that in certain conventional techniques, after the sole has been fully constructed and all grinding has been completed, all or a portion of the sidewalls of the shoe's sole are covered or wrapped (e.g., using a veneer); however, for the reasons noted above, such conventional techniques generally would not be conducive to pre-wrapping the insert 30. The decorative pattern shown on insert 30 could have been applied, e.g., by attaching a veneer that includes the pattern, by wrapping insert 30 with a piece of textile that has been printed with such pattern, or by applying an outer decal having the pattern. FIG. 4 illustrates a completed shoe 35 that includes a permanent insert 40 having a woven outer surface, and FIG. 5 illustrates a completed shoe 45 that includes a permanent insert 50 having a high-gloss or clear plastic coating on its outer surface.

In addition, the overall shape of a wedge 30 according to the present invention can have greater variation than conventionally would be possible. For example, such a wedge 30 can be convex or even highly convex, whereas a highly convex surface typically would interfere with the grinding process when using conventional production techniques.

Still further, because the width of the final decorative wedge 30 according to the present invention does not necessarily need to be the same as the width of the adjacent layers 14 and 15 (or any of the layers 12-16) of the shoe's sole, it often will be possible to use a single-sized decorative wedge 30 for multiple different shoe sizes and/or styles. For example, a single wedge 30 might be used with size 6, 7 and 8 shoes. The fact that the wedge 30 might extend further out from the other layers 12-16 of the soles for the smaller shoes generally will not be a problem where the shoe design is intended to feature a "bulging" wedge 30, or where the design can accommodate either "bulging" or "no bulging". As a result, the number of different-sized wedges 30 (each typically requiring its own mold) can be reduced, thereby reducing manufacturing costs even further.

In another aspect of the invention, insert 30 may be structured so as to have a flexibility gradient along its length or to otherwise have differing levels of flexibility. For example, it often will be preferable to make insert 30 more flexible closer to its front end 25 and more rigid at its rear end 27. Also, all or nearly all of insert 30 preferably is behind the flex point of the shoe's sole where the outsole is most likely to bend, thereby helping to avoid cracking of the more flexible parts of layers 12 through 16.

However, it should be noted that all or a portion of insert 30 (e.g., close to front end 25) may extend beyond the flex point of the shoe's sole (e.g., close to front end 25) if that portion of the insert is approximately as flexible as, or more flexible than, layers 12 through 16. For example, certain wedges 30 according to the present invention are constructed from two different types of materials, with the front portion 25 being made from a material having greater flexibility than the material from which the rear portion 27 is made. Further, it should be noted that the use of denser materials often will allow the decorative designs to last longer, e.g., when the outsole strikes or scrapes against any obstacle that otherwise might scratch or gouge the decoration. The use of denser materials on the thicker part of insert 30 (i.e., near rear end 27) also can make the thicker part of the wedge's cushion effect less likely to be compressed.

It is further noted that the foregoing technique is intended for use in a mass-production medium-scale production or large-scale production manufacturing process. Accordingly, the same temporary wedge 10 (or at least the same temporary wedge design) preferably is used for a number of different shoes coming down the production line. Moreover, because the appearance of the temporary wedge 10 is not important, a single wedge 10 (or a single wedge shape) can be used across a range of different styles (and, as noted above, even a range of different sizes) of shoes, subject to any practical considerations.

Still further, it often will even be possible to use molds for existing shoe wedges (which have tended to be rather plain, having smooth vertical side walls) to create the temporary wedges 10 used in the present invention. Alternatively, the temporary wedges 10 may be fabricated as simple cutouts of any desired material. As a result, it may be possible to implement the technique of the present invention with a great deal of operating or manufacturing efficiency.

It should be noted that the foregoing discussion assumes that the insert (both temporary 10 and final 30) is wedge-shaped, increasing in thickness from front 25 to rear 27. This generally will be the case where the shoe has an elevated heel. However, it should be understood that the foregoing production technique also applies to inserts 10 and 30 which have other shapes (e.g., substantially flat in thickness or substantially flat with a tapered front and/or a rear end). Such alternate shapes might be used, e.g., where significant elevation is not necessarily desired, but where the designer still wishes to provide added rigidity, firmness or support in the rear part of the shoe, while at the same time using a decorative element.

In this regard, it is further noted that the final insert 30 itself preferably is firmer, stronger, more rigid or less pliable than the other layers 12-16 that constitute the shoe's sole. The main goal of a final insert 30 in a shoe 5 according to the present invention is to provide rigidity and/or to provide a desired shaping (and/or decorative impact), with the other layers 12-16 of the shoe's sole typically being flat and cut from sheet material(s).

At any desired point during the process described above, a shoe upper may be attached to one or more of the layers of the shoe sole. Alternatively, the shoe upper may be formed as a unitary piece with one or more of the upper layers of the shoe's sole. Any kind of upper may be used, including simple straps in the case of the sandal, thong or similar shoe.

In the embodiments described above, a temporary insert 10 is used in order to avoid damaging the permanent insert 30 during the grinding step. If the grinding step can be omitted in the production technique, then it often will be possible to omit the use of a temporary insert altogether. For example, in one technique the entire shoe sole, or even the entire shoe, is injection molded as a single unitary piece having an opening that is sized and shaped appropriately to accommodate the permanent insert 30, and then the permanent insert 30 is simply bonded into place within that opening. By injection molding the sole (or the entire shoe) as a single piece, rather than bonding together individual layers to form the sole, the grinding step usually will be unnecessary because no seams or other irregularities should be present.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe sole, comprising:

(a) a plurality of layers bonded together along their adjacent surfaces; and (b) an insert disposed between a first layer and a second layer, said first and second layers being included in the plurality of layers, said second layer being immediately adjacent to said first layer, but wherein said insert is located only at a rear section of said first and second layers, with said first and second layers being bonded directly to each other along a front section, wherein side sections of said plurality of layers have been ground down in order to smooth out sections where the layers do not match precisely and to de-emphasize seams between the layers, and wherein the insert has at least one of decoration, a high-gloss coating, a textile wrap, an outer decal, a clear plastic coating or texturing on its outer surface, extending to at least one of its top edge where it contacts the first layer and its bottom edge where it contacts the second layer.

2. A shoe sole according to claim 1, wherein the insert is wedge-shaped.

3. A shoe sole according to claim 1, wherein the insert is more rigid than the plurality of layers.

4. A shoe sole according to claim 1, wherein the insert is more flexible toward a front end of the shoe sole than it is toward a rear end of the shoe.

5. A shoe sole according to claim 1, wherein the insert has a flexibility gradient along its length.

6. A shoe sole according to claim 1, wherein a portion of the insert extending beyond a flex point of the shoe sole, toward a front end of the shoe sole, is at least approximately as flexible as the plurality of layers.

7. A shoe sole according to claim 6, wherein the portion of the insert extending beyond the flex point of the shoe sole, toward the front end of the shoe sole, is more flexible than the plurality of layers.

8. A shoe sole according to claim 1, wherein a front portion of the insert is made from a first type of material and a rear portion of the insert is made from a second type of material, and the first type of material has greater flexibility than the second type of material.

9. A shoe sole according to claim 1, wherein the insert is wider than the plurality of layers.

10. A shoe sole according to claim 1, further comprising at least one of grooves or a three-dimensional pattern in the side sections of said plurality of layers, formed by the grinding operation.

11. A shoe sole according to claim 1, wherein the insert has a woven outer surface.

12. A shoe sole according to claim 1, wherein the insert has a decorative veneer outer surface.

13. A shoe sole according to claim 1, wherein the insert has a high-gloss coating on its outer surface.

14. A shoe sole according to claim 1, wherein the insert has a textile wrap on its outer surface.

15. A shoe sole according to claim 1, wherein the insert has an outer decal.

16. A shoe sole according to claim 1, wherein the insert has a clear plastic coating.

17. A shoe sole according to claim 1, wherein the insert has an outer surface and decoration covers the entire outer surface of the insert.

18. A shoe sole according to claim 1, wherein the insert has convex sidewalls.

19. A shoe sole according to claim 1, wherein the insert has highly convex sidewalls.

* * * * *